US006592970B2

(12) United States Patent
Ohta et al.

(10) Patent No.: US 6,592,970 B2
(45) **Date of Patent: *Jul. 15, 2003**

(54) INK JET RECORDING MATERIALS

(75) Inventors: Tetsuji Ohta, Houya (JP); Mitsuru Ochiai, Hasuda (JP); Helmut Mangold, Rodenbach (DE)

(73) Assignees: Kimoto Co., Ltd. (JP); Degussa AG (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/417,124

(22) Filed: Oct. 13, 1999

(65) Prior Publication Data

US 2002/0155256 A1 Oct. 24, 2002

(30) Foreign Application Priority Data

Oct. 14, 1998 (JP) ..... 10-291255

(51) Int. Cl.[7] ..... B41M 5/00
(52) U.S. Cl. ..... 428/195
(58) Field of Search ..... 428/328, 331, 428/404, 195

(56) References Cited

U.S. PATENT DOCUMENTS 5,856,001 A * 1/1999 Okumura et al. ..... 428/331
5,955,142 A * 9/1999 Yoshino et al. ..... 428/195
5,965,252 A * 10/1999 Santo et al. ..... 428/329
6,156,384 A * 12/2000 Hutter et al. ..... 427/288
6,238,784 B1 * 5/2001 Mochizuki et al.

FOREIGN PATENT DOCUMENTS

| | | |
|---|---|---|
| EP | 0218956 | 4/1987 |
| JP | 62-286787 | * 12/1987 |
| WO | 98/22388 | 5/1998 |

OTHER PUBLICATIONS

Ink–Jet Printer Technology and the Materials, pp 275–282, '98.
Improvement of Ink–Jet Recording and Recording Paper, Seminar Text, Nov. 28, 2000, Association of Technical Information.
High Quality Ink Jet Media, Mitsuhiro Ikeda, 1999.

* cited by examiner

*Primary Examiner*—Pamela R. Schwartz
(74) *Attorney, Agent, or Firm*—Lorusso, Loud & Kelly

(57) ABSTRACT

An ink jet recording material excellent in all characteristics including drying property, ink absorbency, water resistance and the like, is provided. The ink jet recording material has an ink-receiving layer comprising hydrophilic resin and inorganic pigment, the ink-receiving layer containing silica particles surface-doped with alumina as the inorganic pigment. The alumina-doped silica is prepared by a process employing flame hydrolysis techniques combined with pyrolysis. The ink-receiving layer preferably contains the alumina-doped silica in an amount ranging from 5 to 200 weight parts based on 100 weight parts of the hydrophilic resin.

7 Claims, 2 Drawing Sheets

INK JET RECORDING MATERIALS

BACKGROUND OF THE PRESENT INVENTION

The present invention relates to ink jet recording materials (recording materials for ink jet printing), particularly to ink jet recording materials excellent in ink drying property and glossiness.

Ink-jet printing ranks with electrophotography (PPC) as one of the most popular recording processes. Various kinds of top-coated materials for ink-jet printing have been proposed to obtain an image of high quality. As the top-coating for image receiving, a resin having both good water resistance and ink absorbency is generally used as borne on a substrate such as a paper sheet or a film. There have been proposed materials using a graft-polymer or a block polymer (Japanese Patent Application laid-open Publication No. 61-21780), materials using a polyvinyl pyrrolidone and an acrylic acid polymer (Japanese Patent Application laid-open Publication No. 62-218181) and materials used for both ink-jet printing and PPC (Japanese Patent Application laid-open Publication No. 5-177921).

In most of the conventional ink jet recording materials, inorganic pigments such as clay, talc, silica, alumina (aluminum oxide) and titanium oxide are added to the coating in order to improve the ink absorbency of the material. The inorganic pigments are selected considering their transparency or color (transparent or white).

For example, when transparency of the ink jet recording material is required for the application to CHP etc., a transparent crystalline pigment such as alumina or the like is selected. When the ink jet printing material should be white, a white pigment such as talc, titanium oxide or the like is selected.

When the inorganic pigment is selected, consideration should be given not only to the color of the inorganic pigment but also to the dispersability in a coating solution, its effect on the fluidity of the coating solution, and its effects on ink absorbency or drying property of the ink-receiving layer. However, each of the aforementioned inorganic pigments has different characteristics and does not satisfy all of the requirements.

Therefore, an object of the present invention is to provide an ink jet recording material excellent in all of the characteristics such as drying property, ink absorbency, water resistance and the like. Another object of the present invention is to provide an ink jet recording material capable of providing an image of a high quality.

SUMMARY OF THE PRESENT INVENTION

In order to attain the aforementioned objects, the inventors conducted research on inorganic pigments used for the ink-receiving layer of the ink jet recording material and, as the result, found that silica particles surface-doped with alumina (alumina-doped silica) have both characteristics of silica and those of alumina and that their properties are superior to the two inorganic pigments individually or in mixture.

The ink jet recording material according to the present invention has an ink-receiving layer comprising hydrophilic resin and inorganic pigment, wherein the ink-receiving layer contains silica particles surface-doped with alumina as the inorganic pigment. The amount of the alumina is preferably 0.00001 to 20 wt %.

The alumina-doped silica exhibits good fluidity and good dispersability when it is dispersed in a coating solution, and enables formation of a strong coating layer. The ink-receiving layer containing the alumina-doped silica has high water resistance and excellent ink absorbency and is capable of producing an image of high quality.

The amount of the alumina-doped silica is not particularly limited but is preferably 5–200 parts by weight based on 100 parts by weight of the resin.

According to one preferable embodiment of the present invention, the ink receiving layer is formed on a substrate. As the substrate, plastic film and paper sheet are typical.

When a paper sheet is employed, the ink receiving layer may be formed thereon by coating. Alternatively, the paper itself can be the ink receiving layer. In the latter case, the alumina-doped silica can be added to pulps as a loading material for inner sizing or added to a sizing coating as a pigment thereof in a paper manufacturing process.

PREFERRED EMBODIMENTS OF THE PRESENT INVENTION

The ink jet recording material of the present invention will be explained in more detail hereinafter.

Figure 1A:
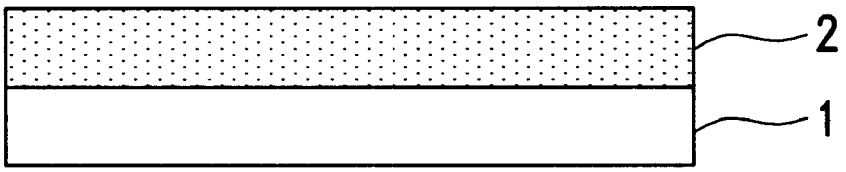
FIGS. 1(*a*) and (*b*) are cross-sectional views of ink jet recording materials of the present invention, where 1 designates a substrate, 2 designates an ink-receiving layer and 3 designates an ink-permeable layer.
Figure 1B:
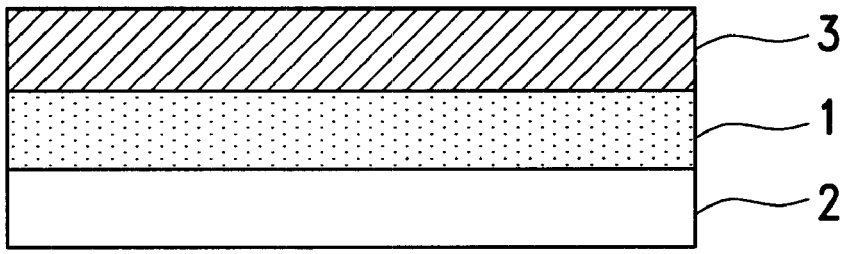

FIG. 1(*a*) is a cross-sectional view of an embodiment of the ink jet recording material according to the present invention. The ink jet recording material has the structure shown in FIG. 1(*a*) of an ink-receiving layer 2 formed on a substrate 1.

As the substrate 1, a transparent or opaque film, for example, a synthetic resin film such as a polyester, polycarbonate, polyethylene, polypropylene, tri-acetyl cellulose, polyvinyl chloride, acrylic resin, polystyrene, polyamide, polyimide, vinylidene chloride-vinyl chloride copolymer or the like, a paper sheet, synthetic paper, cloth, tarpaulin, or a composite of a plastic film and paper or the like can be employed.

The surface of the substrate may be subjected to a treatment for improving adhesiveness so that the ink-receiving layer is easily formed thereon. An anchor coating may be applied to the surface. As the anchor coating, a resing having good adhesiveness to both the resin of the ink receiving layer and the substrate can be employed.

The substrate may be a multiple-layer substrate provided with an adhesion layer, a matte layer or the like on the opposite side from the ink receiving layer for imparting writing property, adhesiveness to other materials, or the like.

The thickness may be selected taking account of feeding or supplying to the ink jet printer and is, for example, in the range of 20 to 200 $\mu$m.

The ink-receiving layer 2 comprises a hydrophilic resin and an inorganic pigment. As the inorganic pigment, alumina-doped silica particles are used.

The alumina-doped silica particles, especially silica particles surface-doped with alumina, have both characteristics of silica and those of alumina and show specific properties, for example, excellent fluidity or dispersability, which silica and alumina does not exhibit individually or in mixture. The amount of the dopant (alumina) is in the range from 0.00001 to 20 wt %, preferably in the range from 0.0001 to 1.0 wt %, more preferably in the range from 0.01 to 0.5 wt %. In this range, the aforementioned properties can be obtained. The particle size (average size) of the silica particles may be 1–300 nm, preferably 10–100 nm, more preferably 60–80 nm.

Processes usable for preparing the alumina-doped silica include: 1) coating silica particles with a solution including an aluminum compound such as $AlCl_3$ and drying and sintering the particles, and 2) flame hydrolysis techniques (feeding a gas mixture of an Al compound and a Si compound into a flame and allowing them to react to form oxides). However, the alumina-doped silica used in the present invention can be also made by the process described in the following, that employs flame hydrolysis techniques combined with pyrolysis. The surface of silica particles can be homogeneously doped with alumina by this process even at very small amounts.

In this process, a gaseous silicon compound (typically halogenated silicon, e.g., $SiCl_4$) is fed into a flame and is homogeneously mixed with an aerosol containing an aluminum compound such as $AlCl_3$. The aerosol containing the aluminum compound is prepared by ultrasonic nebulization using an aerosol generator, which contains a dopant solution or suspension. After the aerosol is mixed homogeneously with the gaseous silicon compound, the mixture is allowed to react in the flame and the resulting alumina-doped silica is separated from the gas stream in a known manner.

This process can prevent formation of an alumina particles and silica particles separately. The resulting alumina-doped silica consists of particles surface-doped with alumina and the BET surface area thereof is between 5 and 600 $m^2/g$. By using the thus-prepared alumina-doped silica for the ink receiving layer, an ink jet printing material having excellent properties can be obtained.

The amount of the alumina-doped silica is not particularly limited but is preferably in the range of from 5 to 200 parts by weight, more preferably 10 to 70 parts by weight, based on 100 weight parts of the hydrophilic resin. When the alumina-doped silica is added to a coating solution in this range, the fluidity and dispersability of the coating solution and the ink drying property of the coated layer (ink-receiving layer) are excellent. While it is difficult to form a film for a coating solution including 100 parts by weight of ordinary silica particles, the alumia-doped silica exhibits low viscosity and good dispersability in the coating solution and is therefore capable of forming a homogeneous film even if 100 parts by weight or more are added to the coating solution.

As the hydrophilic resin, resins generally used for an ink-receiving layer of the conventional ink jet printing materials can be used. A water resistant resin with a good absorbency of aqueous ink is preferably employed. As such a resin, synthetic resins such as polyvinyl alcohols, polyvinyl pyrrolidones, water soluble cellulose resins, water soluble polyester resins, polyvinyl acetal, acrylic acid-acrylic amide copolymer, melamine resins, polyetherpolyol resins and cross-linked compounds thereof and the like, natural resins such as gelatin, casein, starch, chitin, chitosan and the like, And water soluble high-molecular compounds imparted with water resistance to some extent can be exemplified. Hardened polyvinyl alcohols or polyvinyl pyrrolidones obtained by a known process, water soluble resins having a cinnamoyl group, a stilbazolium group, a styrylquinolium group or a diazo group and the like may be employed. These resins are used solely or as any mixture thereof. Combination of polyvinyl pyrrolidones and polyvinyl alcohols or acrylic acids copolymer is preferable for obtaining high water resistance.

The ink-receiving layer may contain, in addition to the alumina-doped silica, other inorganic pigments such as clay, talc, diatom earth, calcium carbonate, calcium sulfate, barium sulfate, aluminum silicate, titanium oxide, zinc oxide, synthetic zeolite, alumina, smectite or the like, to the extent that they do not degrade the properties of the alumina-doped silica. The total amount of the inorganic pigments, including the alumina-doped silica, is in the range of 5 to 200 parts by weight based on 100 parts of the resins.

The ink-receiving layer may further contain optional additives such as anti-foam agents, leveling agents, UV absorbers, light stabilizers, pigments and the like.

The ink jet recording material can be prepared by applying on a substrate a coating solution for the ink-receiving layer comprising the alumina-doped silica, the hydrophilic resin and other additives, if necessary, dissolved or dispersed in a solvent using a known coating method such as bar coating, spray coating or roll coating, and drying the coated layer. When a paper sheet is used as the substrate, it may be impregnated with the coating solution by immersing in the solution.

When a paper sheet is employed as the substrate, the alumina-doped silica can be added to pulps as a loading material for inner sizing or added to a sizing coating as a pigment thereof in a manufacturing process of paper of fine or middle class.

Using a paper sheet as the substrate reduces the amount of coating required for imparting the ink jet recording properties, since the capillarity of pulps helps the ink to wick. On the other hand, for the purpose of obtaining a texture similar to a photograph, a plastic film is preferred because it imparts high glossiness to the ink-receiving layer.

The thickness of the ink-receiving layer is not particularly limited but may be 1–50 $\mu$m, preferably 3–40 $\mu$m.

Although an ink-jet recording material having a basic structure in which the ink-receiving layer 2 is formed on the substrate 1 has been explained, the ink-jet recording material of the present invention is not limited to this and various structures can be realized.

FIG. 1(*b*) shows a multiple-layer ink-jet recording material as another embodiment of the present invention. This ink-jet recording material has a two layer structure of an ink-receiving layer 2 and an ink-permeable layer 3 formed on a substrate 1 in this order. The ink-receiving layer 2 is the same as the above-mentioned ink-receiving layer 2 (FIG. 1(*a*)) and includes a hydrophilic resin and an inorganic pigment as main components. The ink-permeable layer 3 is a porous layer.

Dyes or pigments of ink printed on this ink jet recording material are adsorbed partly in the pores of the ink-permeable layer 3 and the ink which permeates through the ink-permeable layer 3 is absorbed in the ink-receiving layer 2. Thus, high ink drying speed and excellent ink absorbency can be obtained with this ink jet recording material. In addition, the printed surface exhibits high glossiness and a clear image.

EXAMPLES

The present invention will be explained more in detail with reference to the following examples. In the examples, "parts by weight" will be abbreviated to "parts".

Example 1

1. Preparation of Alumina-Doped Silica

Figure 2:
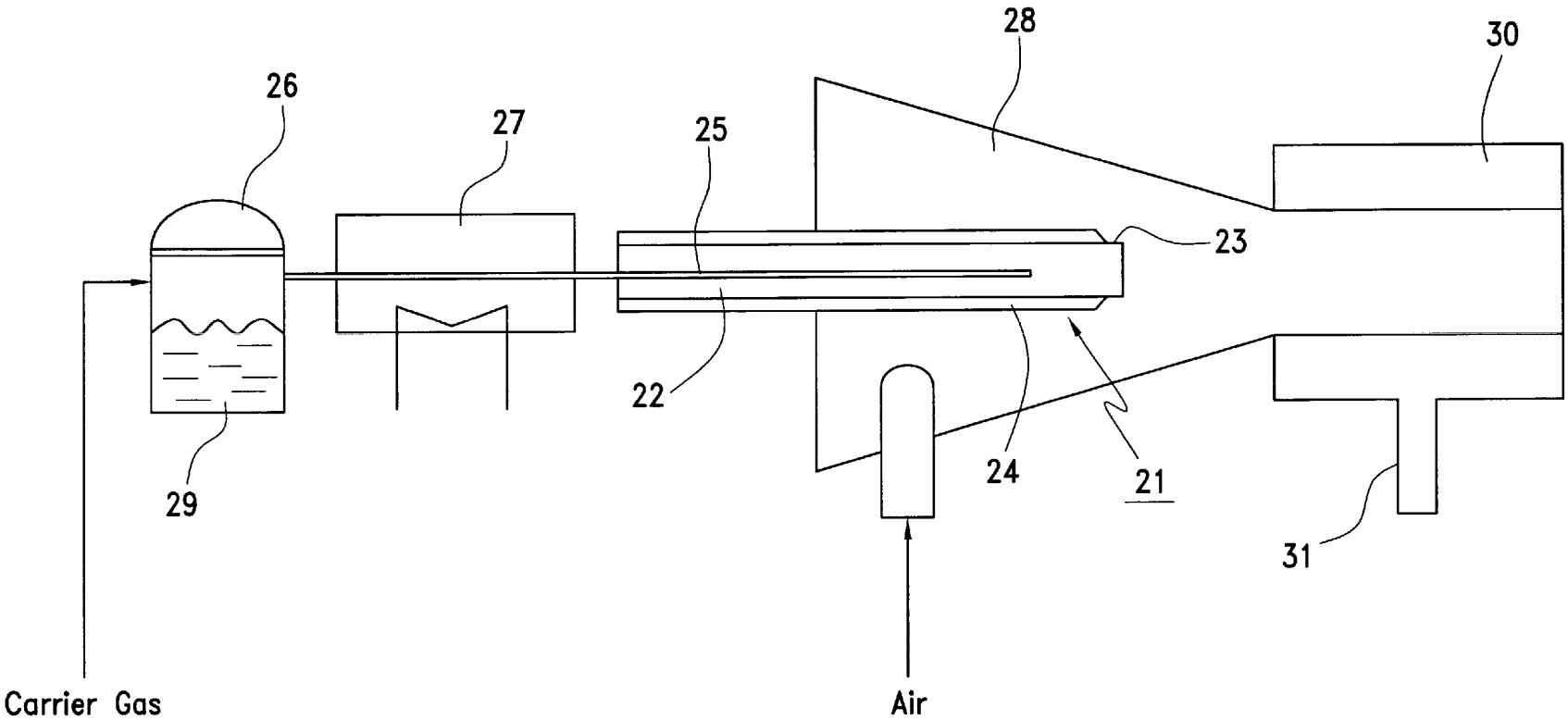
FIG. 2 is a diagram of an apparatus for preparing an alumina-doped silica used for the ink jet recording material of the present invention.

Silica particles surface-doped with alumina were prepared in the following manner by using the apparatus shown in FIG. 2.

5.25 kg/h of $SiCl_4$ was evaporated at about 130° C. and introduced in a central tube 22 of a burner 21. 3.4 $Nm^3/h$ of primary hydrogen and 3.76 $Nm^3/h$ of air were also fed to the central tube 22. The gas mixture jetted out of an inner nozzle 23 of the burner 21 and burned in a combustion chamber 28 and a water-cooled flame tube 30 connected in series there-with. 0.5 $Nm^3/h$ of secondary hydrogen was fed to a mantle nozzle 24 surrounding the inner nozzle 23 in order to prevent caking of the nozzle. An additional 20 $Nm^3/h$ of secondary air was fed to the combustion chamber 28.

On the other hand, an aluminum salt aerosol was produced in an amount of 460 g/h by ultrasonic nebulization of a 2.2% aqueous aluminum chloride solution in an aerosol generator 26. The aerosol was passed through a heated pipe 27 with the assistance of 0.5 $Nm^3/h$ of air as carrier gas, where the aerosol was converted into a gas and a salt crystal aerosol at temperatures around 180° C. The aerosol jetted out of an axial tube 25 into the central tube 22. At the mouth of the burner 21, the temperature of the gas mixture ($SiCl_4$/air/hydrogen, aerosol) was 156° C.

The reaction gases and the resulting pyrogenically prepared silica, doped with alumina, were removed under suction via a cooling system 31 by applying a reduced pressure and thus cooled to about 100 to 160° C. The solid was separated from the gas stream in a filter or cyclone.

In a further step, adhering hydrochloric acid residues were removed from the alumina-doped silica by treatment with water vapor-containing air at elevated temperatures. The particle size of thus prepared Al-doped silica was 80 nm and the amount of alumina was approximately 0.25% by weight.

2. Preparation of an Ink Jet Recording Material

A coating solution for an ink-receiving layer having the following composition was applied to a polyethylene terephthalate film (Melinex; Du Pont) of a thickness of 100 $\mu$m in amount of 5–5.5 $g/m^2$ by a bar coater and dried to form an ink-receiving layer.

| Composition of the coating solution for ink-receiving layer | |
|---|---|
| polyvinyl alcohol | 30 parts |
| polyvinyl pyrrolidone | 50 parts |
| alumina-doped silica | 50 parts |
| (average particle size: 80 nm, alumina content: 0.25%) | |
| water | 520 parts |

Fluidity(viscosity) and dispersability of the coating solution, drying time, transparency and wicking of the ink-receiving layer and print quality after ink-jet printing were evaluated. The results are shown in Table 1. In Table 1, ⊙, ○, Δ and X indicate excellent, good, practical but not so good, and bad, respectively.

TABLE 1

| Inorganic Pigment | Example 1 Alumina-doped Silica | Comparative Example 1 Alumina-Silica Mixed Oxide | Comparative Example 2 Silica | Comparative Example 3 Alumina |
|---|---|---|---|---|
| Viscosity (mPa.S) | 210 | 420 | 1200 | 330 |
| Dispersability | ⊙ | ○ | ○ | ○ |
| Wicking (mm) | 27 | 31 | 26 | 22 |
| Drying time (sec) | 160 | 189 | 165 | 209 |
| Transparency | ⊙ | ○ | Δ | ○ |
| Print Quality | ○ | ⊙ | ○ | ○ |

Comparative Example 1

A coating solution for an ink-receiving layer having the following composition was applied to a polyethylene terephthalate film the same as that of Example 1 in amount of 5–5.5 $g/m^2$ by a bar coater and dried to form an ink-receiving layer. The silica-alumina mixed oxide used in this example is commercially available (Aerosil MOX 170: Degussa A. G.) and the particles thereof consist of homogeneous mixture of silica and alumina.

| Composition of the coating solution for ink-receiving layer | |
|---|---|
| polyvinyl alcohol | 30 parts |
| polyvinyl pyrrolidone | 50 parts |
| silica-alumina mixed oxide | 50 parts |
| (average particle size: 15 nm, alumina content: 1%) | |
| water | 520 parts |

The properties of the coating solution and the properties of the ink-receiving layer of this ink-jet recording material were also evaluated in the same manner as that of Example 1 and the results are shown in Table 1.

Comparative Examples 2,3

Ink-receiving layers were formed on the same polyethylene terephthalate film as Example 1 in a manner similar to that of Example 1 to produce ink jet recording materials, except that silica (Aerosil 200:Nippon Aerosil Co., Ltd.) and alumina (Aluminium Oxide C: Degussa AG) were used in Comparative Examples 2 and 3, respectively, instead of the alumina-doped silica.

The properties of the coating solutions and the properties of the ink-receiving layers of these ink-jet recording materials were also evaluated in a manner same as that of Example 1 and the results are shown in Table 1.

As shown in Table 1, the coating solution of Example 1 exhibited excellent dispersability and good fluidity. A coating film of a desired thickness could be easily formed by using this solution. Its properties were superior to those obtained by Comparative Examples using silica or alumina. The ink jet recording material of the Example 1 also showed drying property superior to any of Comparative Examples. These results indicate that the alumina-doped silica has unique properties. It was also found that the ink-receiving layer of Example 1 had a transparency similar to that of the ink jet recording material using alumina or silica and a good image quality was obtained similarly to the ink-jet recording material using alumina or silica.

Examples 2–4

Coating solutions for an ink-receiving layer having the following composition were prepared using the same alumina-doped silica as in Example 1 and various kinds of hydrophilic synthetic resins.

| Composition of the coating solution for ink-receiving layer | |
|---|---|
| hydrophilic synthetic resin | 10 parts |
| inorganic pigment (alumina-doped silica) | 10 parts |
| dispersing medium | 80 parts |

As the hydrophilic synthetic resin, polyvinyl alcohol (GOHSENOL: Nippon Synthetic Chemical Industry Co., Ltd.), cation-modified polyvinyl alcohol (C-318-A: Nippon Synthetic Chemical Industry Co., Ltd.) and a mixture of acrylate copolymer and polyvinyl pyrrolidone in a ratio of 3:2 by weight were used in Examples 2, 3 and 4, respectively. The dispersion medium was water in Examples 2 and 3, and meta-denatured alcohol in Example 4.

Monomers of the acrylate copolymer used in Example 4 were methylmethacrylate 45 mol %, butylmethacrylate 10 mol %, hydroxy-ethylmethacrylate 30 mol % and dimethylamino-ethylmethacrylate 15 mol %.

Each of the coating solutions was applied to a polyethylene terephthalate film (Melinex 535: Du Pont) and dried to form an ink jet recording material having an ink-receiving layer of a thickness of 25 $\mu$m.

Comparative Examples 4–7

Coating solutions for an ink-receiving layer having the following composition were prepared in a manner similar to that of Example 2 using the same polyvinyl alcohol (GOHSENOL: Nippon Synthetic Chemical Industry Co., Ltd.) as in Example 2 and various kinds of inorganic pigments.

| Composition of the coating solution for ink-receiving layer | |
|---|---|
| hydrophilic synthetic resin (polyvinyl alcohol) | 10 parts |
| inorganic pigment | 10 parts |
| water | 80 parts |

As the inorganic pigment, silica (Aerosil 200:Nippon Aerosil Co., Ltd.), alumina (Degussa AG) and silica (MIZUKASIL: Mizusawa Industrial Chemicals) were used in Comparative Examples 4, 5, 6, respectively. In Comparative Example 7, a coating solution including no inorganic pigment was prepared using 10 parts or polyvinyl alcohol (GOHSENOL: Nippon Synthetic Chemical Industry Co., Ltd.) and 90 parts of water. Ink jet recording materials were prepared using these coating solutions in a manner similar to that of Example 2.

For each of Examples 2–4 and Comparative Examples 4–7, fluidity(viscosity) and dispersability of the coating solution were evaluated. Film strength, transparency, water-resistance and ink-absorbing speed of the ink-receiving layer, and print quality after ink-jet printing were also evaluated. The results are shown in Table 2.

TABLE 2

| | Coating solution | | Coating layer | | | | |
|---|---|---|---|---|---|---|---|
| | Fluidity | Dispersability | Film strength | Transparency | Water resistance | Ink absobing speed | Print Quality |
| Example 2 | ○ | ○ | ○ | ○ | x | ○ | ○ |
| Example 3 | ○ | ○ | ○ | ○ | x | ○ | ○ |
| Example 4 | ○ | ○ | ○ | ○ | ○ | ○ | ○ |
| Comp. Exam. 4 | x | ○ | x | x | x | ○ | Δ |
| Comp. Exam. 5 | ○ | x | ○ | ○ | x | ○ | ○ |
| Comp. Exam. 6 | x | ○ | x | x | x | ○ | Δ |
| Comp. Exam. 7 | ○ | — | ○ | ○ | x | x | x |

In evaluation of the fluidity, ○ indicates that the coating was easily applied to the film by Mayer bar coating, and X indicates that it was difficult to apply the coating to the film. Regarding the dispersability, ○ indicates that the pigment was homogeneously dispersed in the medium (water) and X indicates that the dispersion was not stable. Regarding the film strength, ○ indicates that cohesive failure did not occur by peel test using an adhesive-backed tape and X indicates that cohesive failure occurred. Regarding the transparency of the layer, ○ indicates that the substrate film could be seen through the layer and X indicates that the substrate was hidden by the layer. The water-resistance of the layer was evaluated by immersing the ink jet material in distilled water of 25° C. for 5 minutes. In the evaluation, ○ indicates that the layer remained unchanged after 5 minutes and X indicates that the layer was dissolved in water.

For evaluating the ink absorbing speed and the print quality, an ink image was printed on each of the ink jet recording materials by an ink jet printer (PM700C: Seiko Epson Corporation). In evaluation of the ink absorbing speed, ○ indicates that the ink image dried within 5 minutes after printing and X indicates that the ink image did not dry within 5 minutes. Regarding the print quality, ○ indicates good, Δ indicates that the image was blurred, and X indicates that the image could not be formed on the material.

As apparent from the results shown in Table 2, when silica was used as the inorganic pigment (Comparative Examples 4, 6), a coating layer with sufficient film strength could not be formed owing to bad fluidity and the ink image printed on the material was blurred. When alumina was used as the inorganic pigment (Comparative Example 5), the dispersability was bad.

In contrast with these Comparative Examples, the coating solutions of Example 2–4 were excellent in both fluidity and dispersability, no matter which hydrophilic resin was used. A homogeneous ink-receiving layer could be formed easily by using the coating solutions. In addition, all of the ink jet recording materials of Example 2–4 were excellent in film strength, transparency and ink drying speed and good printing quality was obtained with all of the materials. Particularly, the ink jet material of Example 4 which employed a combination of acrylate copolymer and polyvinyl pyrrolidone as a hydrophilic resin, showed excellent water resistance in addition to the above-mentioned properties.

Advantage of the Present Invention

The ink-jet recording material of the present invention, by using alumina-doped silica as an inorganic pigment for the ink-receiving layer comprising a hydrophilic resin and inorganic pigments, is excellent in all of properties, including ink-drying property, ink-absorbency, water resistance and the like, and is capable of producing an image of high quality.

What is claimed is:

1. An ink jet recording material having a substrate and an ink-receiving layer superimposed on said substrate, said ink-receiving layer comprising a hydrophilic resin and an inorganic pigment, wherein the ink-receiving layer comprises pyrogenically prepared silica particles surface-doped with alumina as the inorganic pigment; and wherein said silica particles are formed by a method comprising:

forming a gas feed containing a gaseous silicon compound;

forming an aerosol containing an aluminum compound;

mixing said gas feed and said aerosol to form a mixed feed; and feeding the mixed feed into a flame to form said silica particles.

2. The ink jet recording material of claim 1, wherein the silica particles are doped with alumina at 0.00001 to 20 wt. %.

3. The ink jet recording material of claim 1, wherein the amount of the silica particles doped with alumina is in the range of from 5 to 200 weight parts based on 100 weight parts of the hydrophilic resin.

4. The ink jet recording material of claim 1, wherein the substrate is a paper sheet.

5. The ink jet recording material of claim 1, wherein the substrate is a plastic film.

6. The ink-jet recording material of claim 1, having a BET surface area of between 5 and 600 $m^2/g$.

7. The ink jet recording medium of claim 1 wherein said particles have an average particle size of 60–80 nm.

* * * * *

UNITED STATES PATENT AND TRADEMARK OFFICE

CERTIFICATE OF CORRECTION

PATENT NO. : 6,592,970 B2
DATED : July 15, 2003
INVENTOR(S) : Ohta et al.

It is certified that error appears in the above-identified patent and that said Letters Patent is hereby corrected as shown below:

Title page,
Item [75], Inventors, "Tetsuji Ohta, Houya (JP)" should read -- Tetsuji Ohta, Tokyo, (JP) --; and "Mitsuru Ochiai, Hasuda (JP)" should read -- Mitsuru Ochiai, Saitama (JP) --.

Column 1,
Line 31, "CHP" should read -- QHP --.

Column 3,
Line 54, "And" should read -- and --.

Signed and Sealed this

Twenty-seventh Day of January, 2004

JON W. DUDAS
*Acting Director of the United States Patent and Trademark Office*